US006532597B2

(12) United States Patent
Bignon et al.

(10) Patent No.: US 6,532,597 B2
(45) Date of Patent: Mar. 18, 2003

(54) PROTECTIVE GLOVE

(75) Inventors: Lucas Bignon, Cachan (FR); Mathieu Lion, Paris (FR)

(73) Assignee: Mastrad (FR)

( * ) Notice: Subject to any disclaimer, the term of this patent is extended or adjusted under 35 U.S.C. 154(b) by 0 days.

(21) Appl. No.: 10/002,756

(22) Filed: Oct. 17, 2001

(65) Prior Publication Data

US 2002/0078490 A1 Jun. 27, 2002

(30) Foreign Application Priority Data

Dec. 22, 2000 (FR) ..... 00 16910

(51) Int. Cl.[7] ..... A41D 19/00
(52) U.S. Cl. ..... 2/161.6; 2/16; 2/163; 15/227
(58) Field of Search ..... 2/16, 20, 158, 2/161.6, 163, 167, 161.8; 15/227

(56) References Cited

U.S. PATENT DOCUMENTS

| | | | | |
|---|---|---|---|---|
| 2,229,837 A | | 1/1941 | Claffy | 2/168 |
| 3,148,125 A | | 9/1964 | Velonis et al. | 264/301 |
| 4,603,439 A | * | 8/1986 | Golomb | 2/18 |
| 4,660,228 A | * | 4/1987 | Ogawa et al. | 2/167 |
| 4,845,781 A | * | 7/1989 | Strickland et al. | 2/161 |
| 4,916,757 A | * | 4/1990 | Berlin et al. | 2/159 |
| 5,020,160 A | * | 6/1991 | Cano | 2/159 |
| 5,134,746 A | * | 8/1992 | William | 15/227 |
| 5,452,478 A | * | 9/1995 | Rombach et al. | 2/161.6 |
| 5,862,916 A | | 1/1999 | Utecht | 206/570 |
| 5,907,870 A | * | 6/1999 | Monroe et al. | 2/161.7 |

FOREIGN PATENT DOCUMENTS

| | | | |
|---|---|---|---|
| DE | 19837247 A1 | 8/1999 | A41D/13/08 |

* cited by examiner

*Primary Examiner*—John J. Calvert
*Assistant Examiner*—Katherine Moran
(74) *Attorney, Agent, or Firm*—Blakely Sokoloff Taylor & Zafman

(57) ABSTRACT

The present invention provides a glove, in particular for housework, the glove being made integrally of silicone material and possessing an ambidextrous shape comprising a main pocket designed to receive four fingers of a user, and a secondary pocket designed to receive the thumb, said secondary pocket opening out into the main pocket.

13 Claims, 3 Drawing Sheets

PROTECTIVE GLOVE

The present invention relates to the field of protective gloves, in particular for housework.

BACKGROUND OF THE INVENTION

Numerous types of gloves have already been proposed, differing in particular in shape and/or in the material from which they are made.

Nevertheless, no presently available glove gives full satisfaction for housework.

In particular, known gloves are poor at withstanding heat, flame, aggressive chemicals; they do not provide any protection against scalding, by steam, oil, water.

OBJECT AND SUMMARY OF THE INVENTION

The object of the present invention is to provide a novel glove presenting properties better than those of known prior gloves.

In the context of the present invention, this object is achieved by a glove, in particular for housework, the glove being made integrally of silicone material and possessing an ambidextrous shape comprising a main pocket designed to receive four fingers of a user, and a secondary pocket designed to receive the thumb, said secondary pocket opening out into the main pocket.

The term "made integrally of silicone material" means, in the context of the present invention, that the glove is made out of silicone material alone without any other component material, and in particular without any fabric reinforcement or the equivalent.

The term "ambidextrous" means that the glove can be used equally well by a left-handed user as by a right-handed user.

BRIEF DESCRIPTION OF THE DRAWINGS

Other characteristics, objects, and advantages of the present invention will appear on reading the following detailed description and on looking at the accompanying drawings given by way of non-limiting example, and in which.

MORE DETAILED DESCRIPTION

Figure 2:
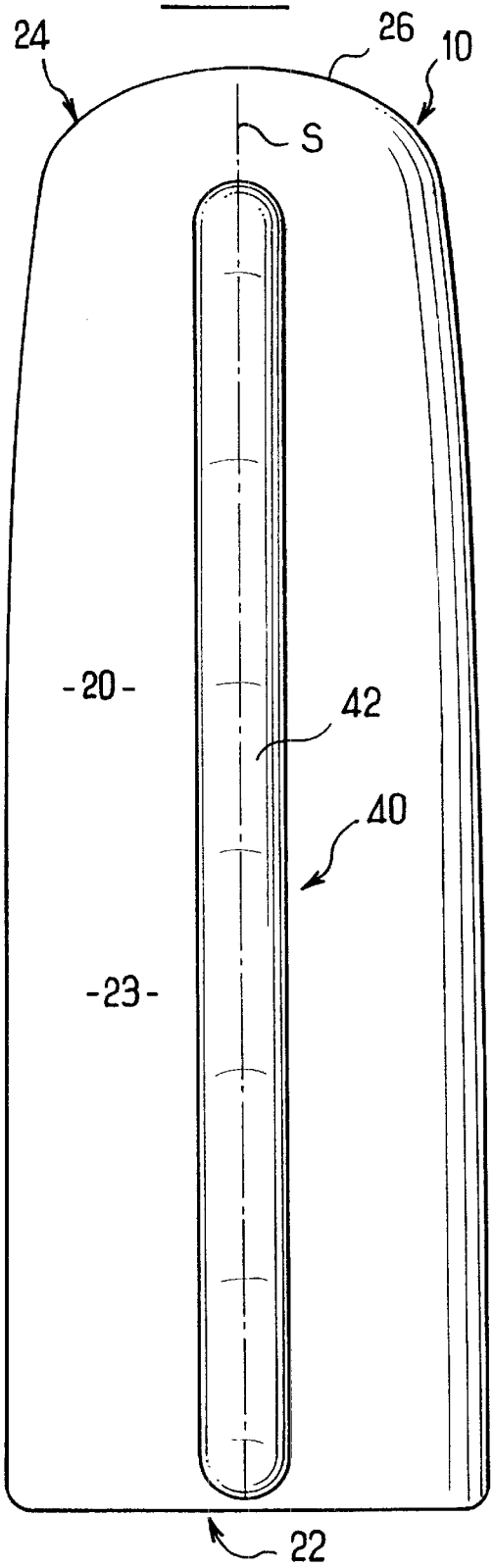
FIG. 2 is a second plan view of a glove of the present invention, as seen from above.

The accompanying figures show an ambidextrous glove 10 made entirely out of silicone material.

The glove 10 is in the form of a mitten. I.e. the glove 10 of the invention has a single separation, for the thumb only.

Still more precisely, the glove 10 comprises a main pocket 20 for receiving four fingers, namely the index, the middle, the ring, and the little fingers.

The pocket 20 has a generally oblong opening 22 which is typically elliptical in shape in use.

From this opening outline, the main pocket 20 tapers progressively in section. The main pocket 20 is generally rounded and closed at its end 24 remote from the opening 22. At this end 24, the main pocket 20 has an outwardly convex curved tip 26.

The mitten 10 also has a secondary pocket 30 for receiving the thumb.

The secondary pocket 30 is connected to the main pocket 20 and opens out into it substantially halfway along the main pocket 20.

The secondary pocket 30 also tapers progressively in section from its open outline 32 that opens out into the main pocket.

At its opposite end, the rounded secondary pocket 30 is closed by a curved tip 34.

The length of the secondary pocket 30 is shorter than the length of the main pocket 20.

Figure 1:
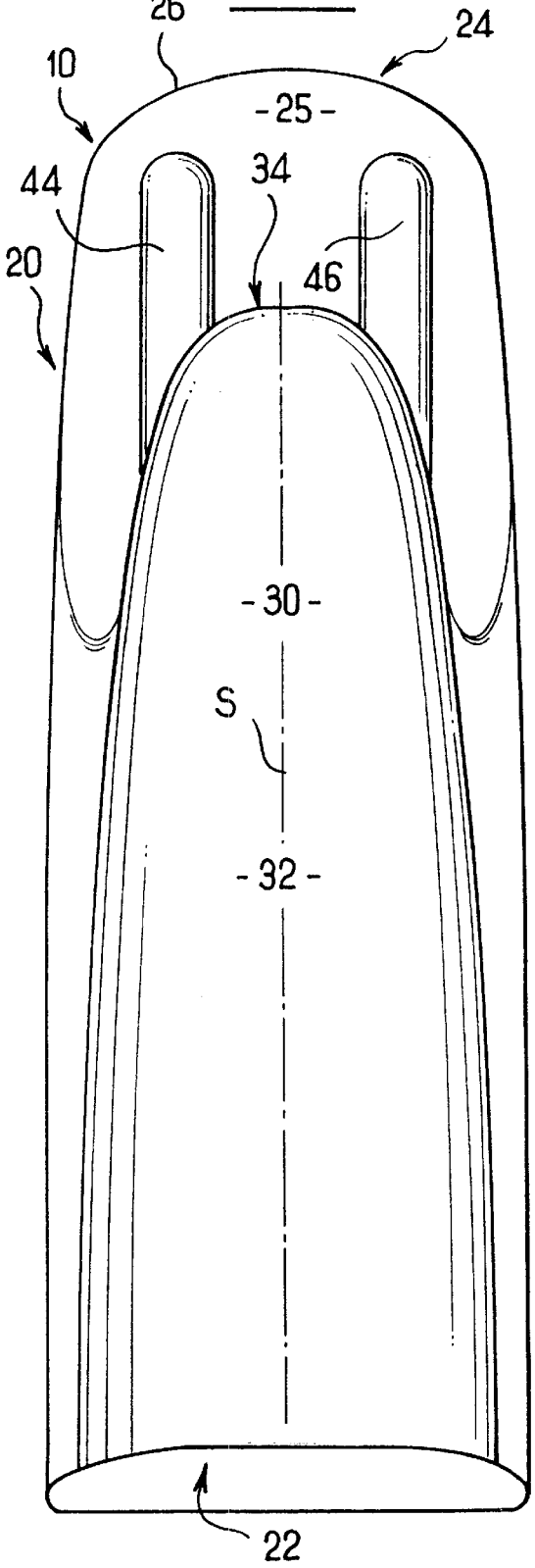
FIG. 1 is a first plan view of a glove of the present invention, as seen from beneath.
Figure 4:
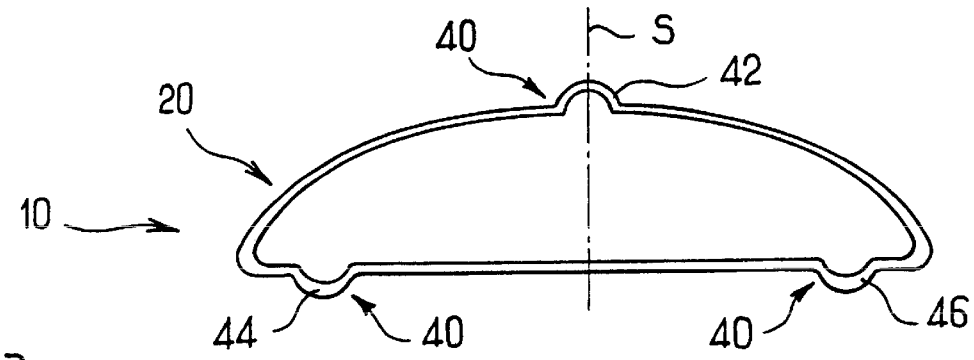
FIG. 4 is a fragmentary section view on section plane IV—IV of FIG. 3.
Figure 3:
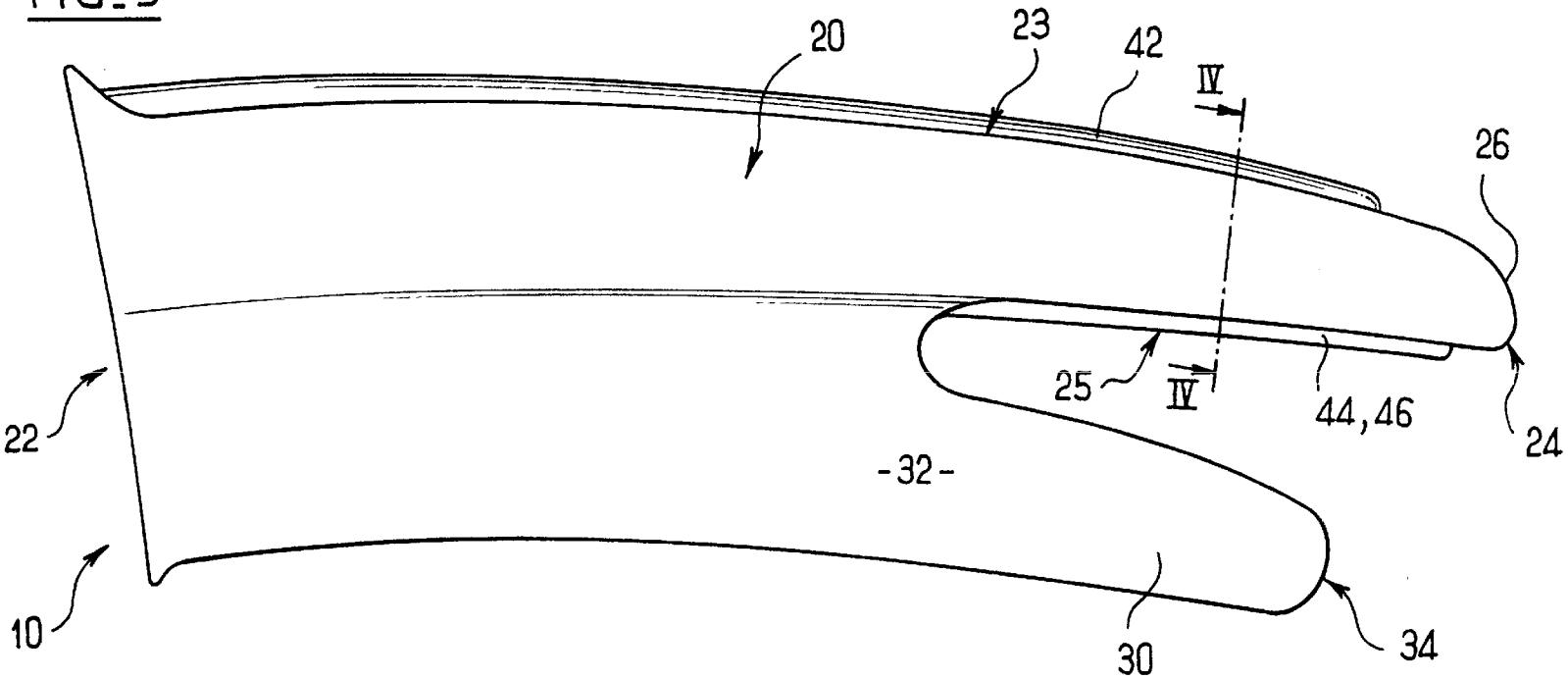
FIG. 3 is a side view of the same glove of the present invention.

As mentioned above, the mitten 10 possesses a plane of symmetry. This plane of symmetry is referenced S in the accompanying figures. The plane of symmetry S is perpendicular to the plane of FIGS. 1, 2, and 4, and parallel to the plane of FIG. 3.

In the invention, the rear face 23 of the main pocket 20 which forms the back of the glove remote from the secondary pocket 30 is preferably curved and outwardly convex. Conversely, the front face 25 of the main pocket 20 is generally concave towards the secondary pocket 30 for receiving the thumb.

Having the main pocket 20 in a rounded shape in this way makes it easier for the user to put the hand inside the glove.

Where the appropriate, it is possible to include projecting reinforcement or ribs on the inside face or the outside face or indeed both faces, both of the main pocket 20 and of the secondary pocket 30. In addition, to the reinforcing effect, such ribs reduce contact between the glove and objects that are being handled, and consequently limit the transfer of heat to the hand of the user.

In a preferred embodiment of the invention, the figures thus show three ribs 40: a central longitudinal rib 42 on the back 23 and two parallel longitudinal ribs 44 and 46 on the front face 25 above the zone that connects with the secondary pocket 30.

The glove of the present invention can naturally be embodied in numerous ways concerning its particular shape and its dimensions, nevertheless in a preferred embodiment:

- when flat, the length of the opening outline 22 is about 13 centimeters (cm);
- in use, the section of the opening outline 22 is about 30 square centimeters ($cm^2$);
- the total length of the main pocket is about 25 cm;
- the length of the secondary pocket 30 is about 8 cm;
- the length of the secondary pocket 30 in the flattened state, across its opening outline 32 where it joins the main pocket 20 is about 9 cm; and
- the width of the main pocket 20 in the flattened state, at a distance of about 20 cm from its opening outline is about 9 cm.

The glove of the present invention presents numerous properties and advantages compared with known gloves, in particular, it:

is leakproof;
is insulating;
does not melt;
is machine washable;
is non-slip;
is ambidextrous;

does not burn; and does not blacken.

Naturally, the present invention is not limited to the particular embodiment described above but extends to any variant in compliance with the spirit of the invention.

For example, the glove of the present invention can be fitted close to the outline opening 22 with a strap 50 for making it easier to keep the glove on the wrist.

Figure 5:
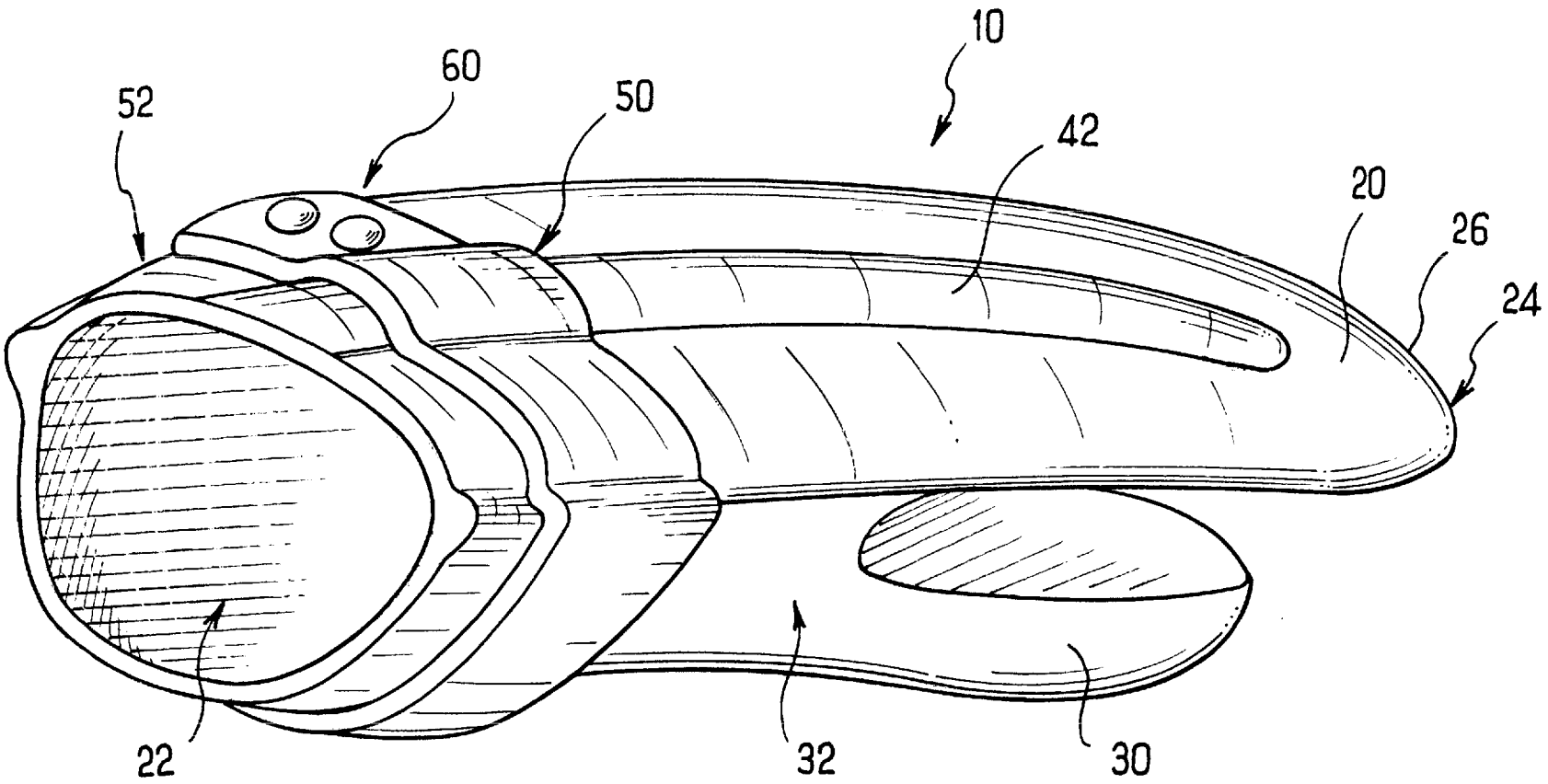
FIG. 5 is a perspective view of a variant glove in accordance with the present invention.

This strap can comprise two elements that are connected to the glove in a spaced-apart configuration and they have respective complementary fastener elements (e.g. of the hook/velvet, stud/ slot, button, etc. type) enabling the strap to be adjusted to the size of the wrist. Or as shown in FIG. 5, the stap can comprise a single element having a first end 52 fixed to the glove and provided with fastening means 60 of the kind mentioned above and its second end for co-operating with complementary means provided on the glove, preferably close to the location where the first end 52 is fixed thereto (and preferably on the back of the glove). The strap 50 can be made of silicone, being integrally molded with the glove, or it can be constituted by a separate element fixed to the glove by any appropriate means.

We claim:

1. A glove, in particular, for house work, the glove being made integrally of silicon material and for a right hand and a left hand, interchangeably, comprising a main pocket designed to receive four fingers of a user, and a secondly pocket designed to receive the thumb, said secondary pocket opening out into the main pocket, wherein said main pocket and said second pocket each have a longitudinal axis substantially parallel to one another, and wherein a plane of symmetry runs through the longitudinal axes of said main pocket and said second pocket.

2. A glove according to claim 1, having a plane of symmetry.

3. A glove according to claim 1, wherein a face forming the back of the glove is rounded, being outwardly convex.

4. A glove according to claim 1, wherein a front face of a main pocket is outwardly concave.

5. A glove according to claim 1, including projecting ribs or reinforcement on at least one of its inside and outside surfaces.

6. A glove according to claim 1, having a rib on an outside face of its back.

7. A glove according to claim 1, having a ribs on an outside face of its front surface.

8. A glove according to claim 1, including a strap having fastener means for fixing onto the wrist of the user.

9. A glove, in particular for housework, the glove being made integrally of silicone material and for a right hand and a left hand, interchangeably, comprising a main pocket designed to receive four fingers of a user, and secondary pocket designed to receive the thumb, said secondary pocket opening out into the main pocket, wherein said pocket and said second pocket each have a longitudinal axis substantially parallel to one another, said glove has a plane of symmetry, the glove has a generally oblong opening, the main pocket tapers progressively in section from this opening, the secondary pocket is shorter than the length of the main pocket, a face forming the back of the glove is rounded, being outwardly convex, the front face of the main pocket is outwardly concave, said glove comprises a projecting central longtiudinal rib on the outside face of its back, and ribs on the outside face of its front surface wherein said plane of symmetry runs through said longitudinal axes of said main pocket and said second pocket.

10. A glove, in particular for housework, the glove being made integrally of silicone material and for a right hand and a left hand, interchangeably, comprising a main pocket designed to receive four fingers of a user, and a secondary pocket designed to receive the thumb, said secondary pocket opening out into the main pocket, wherein said main pocket and said second pocket each have a longitudinal axis substantially parallel to one another, said glove has a plane of symmetry, wherein said plane of symmetry runs through said longitudinal axes of said main pocket and said pocket, the glove has a generally oblong opening, the main pocket tapers progressively in section from this opening, the secondary pocket is shorter than the length of the main pocket, a face forming the back of the glove is rounded, being outwardly convex, a front face of the main pocket is outwardly concave, said glove comprises a projecting central longitudinal rib on the outside face of its back, and ribs on the outside face of its front surface, and wherein when flat, the length of the opening outline is about 13 centimeters;

in use, the section of the opening outline is about 30 square centimeters;

the total length of the main pocket is about 25 cm;

the length of the secondary pocket is about 8 cm;

the length of the secondary pocket in the flattened state, across its opening outline where it joins the main pocket is about 9 cm; and the width of the main pocket in the flattened state, at a distance of about 20 cm from its opening outline is about 9 cm.

11. A glove, in particular for housework, the glove being made integrally of silicone material and for a right hand and a left hand, interchangeably, comprising a main pocket designed to receive four fingers of a user, and a secondary pocket designed to receive the thumb, said secondary pocket opening out into the main pocket, wherein said main pocket and said second pocket each have a longitudinal axis substantially parallel to one another, and said glove comprises a projecting central longitudinal rig on the outside face of its back, and ribs on the outside face of its front surface, wherein said glove has a plane of symmetry, which runs through said longitudinal axes of said main pocket and said second pocket.

12. A glove, in particular for housework, the glove being made integrally of silicone material and for a right hand and a left hand, interchangeably, comprising a main pocket designed to receive four fingers of a user, and a secondary pocket designed to receive a thumb, said secondary pocket opening out into the main pocket, wherein said main pocket and said second pocket each have a longitudinal axis substantially parallel to one another, wherein said glove has a plane of symmetry a face forming the back of the glove is rounded, being outwardly convex, a front face of the main pocket is outwardly concave, and said glove includes projecting ribs or reinforcement on at least one of its inside and outside surfaces, wherein said plane of symmetry runs through said longitudinal axes of said main pocket and said second pocket.

13. A glove comprising:

first pocket configured to receive four fingers;

a second pocket configured to receive a thumb;

wherein the glove is made integrally of silicone material, wherein the first pocket has a first longitudinal axis, wherein the second pocket has a second longitudinal axis, wherein the first longitudinal axis is parallel to the second longitudinal axis, and wherein the glove has a plane of symmetry that runs through the longitudinal axes of the first and second pockets.

* * * * *

UNITED STATES PATENT AND TRADEMARK OFFICE

CERTIFICATE OF CORRECTION

PATENT NO. : 6,532,597 B2
DATED : March 18, 2003
INVENTOR(S) : Bignon et al.

It is certified that error appears in the above-identified patent and that said Letters Patent is hereby corrected as shown below:

Column 3,
Line 52, please delete “pocket” and insert -- main pocket --.

Signed and Sealed this

Fourth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,532,597 B2
DATED : March 18, 2003
INVENTOR(S) : Bignon et al.

It is certified that error appears in the above-identified patent and that said Letters Patent is hereby corrected as shown below:

Column 3,
Line 24, please delete “silicon” and insert -- silicone --.
Line 26, please delete “secondly” and insert -- secondary --.
Line 49, after “and” please insert -- a --.

Signed and Sealed this

Fourteenth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,532,597 B2
DATED : March 18, 2003
INVENTOR(S) : Bignon et al.

It is certified that error appears in the above-identified patent and that said Letters Patent is hereby corrected as shown below:

Column 3,
Line 43, please delete “a” and insert -- two --.

Signed and Sealed this

Seventeenth Day of May, 2005

JON W. DUDAS
*Director of the United States Patent and Trademark Office*